US007219711B2

(12) United States Patent
Keller et al.

(10) Patent No.: US 7,219,711 B2
(45) Date of Patent: May 22, 2007

(54) HYDRAULIC DOOR OPENING MECHANISM AND METHOD OF INSTALLING A BI-FOLD DOOR

(75) Inventors: Richard D. Keller, Hastings, MN (US); Daniel Keller, River Falls, WI (US); Damian Keller, River Falls, WI (US); William Bakalich, River Falls, WI (US)

(73) Assignee: Hi-Fold Door Corporation, River Falls, WI (US)

( * ) Notice: Subject to any disclaimer, the term of this patent is extended or adjusted under 35 U.S.C. 154(b) by 373 days.

(21) Appl. No.: 11/037,796

(22) Filed: Jan. 18, 2005

(65) Prior Publication Data

US 2005/0199355 A1 Sep. 15, 2005

Related U.S. Application Data

(60) Provisional application No. 60/537,570, filed on Jan. 20, 2004, provisional application No. 60/589,754, filed on Jul. 21, 2004.

(51) Int. Cl.
*E05D 15/26* (2006.01)

(52) U.S. Cl. ..... 160/213; 160/188

(58) Field of Classification Search ..... 160/213, 160/207, 188, 189, 310, 311, 206, 405; 49/199
See application file for complete search history.

(56) References Cited

U.S. PATENT DOCUMENTS

| | | | | |
|---|---|---|---|---|
| 2,491,261 | A * | 12/1949 | Greer | 160/188 |
| 4,102,382 | A * | 7/1978 | Vesbach | 160/188 |
| 4,545,418 | A * | 10/1985 | List et al. | 160/213 |
| 4,609,027 | A * | 9/1986 | Keller | 160/207 |
| 4,896,714 | A * | 1/1990 | Ellis | 160/311 |
| 5,168,914 | A * | 12/1992 | Keller | 160/207 |
| 5,343,923 | A * | 9/1994 | Keller | 160/207 |
| 6,056,037 | A * | 5/2000 | Jonkman, Sr. et al. | 160/207 |
| 6,199,617 | B1 * | 3/2001 | Schweiss | 160/193 |
| 6,547,292 | B1 * | 4/2003 | Keller | 292/242 |

* cited by examiner

*Primary Examiner*—David M. Purol
(74) *Attorney, Agent, or Firm*—Leffert Jay & Polglaze, P.A.

(57) ABSTRACT

A hydraulic door opening mechanism for overhead bi-fold doors is herein disclosed. The door opening mechanism mounts a hydraulic pump, pressure reservoir, valve manifold, and a hydraulic motor or cylinder on a first door panel. The door opening mechanism is pre-assembled with the doorframe prior to mounting the door in the door opening.

18 Claims, 6 Drawing Sheets

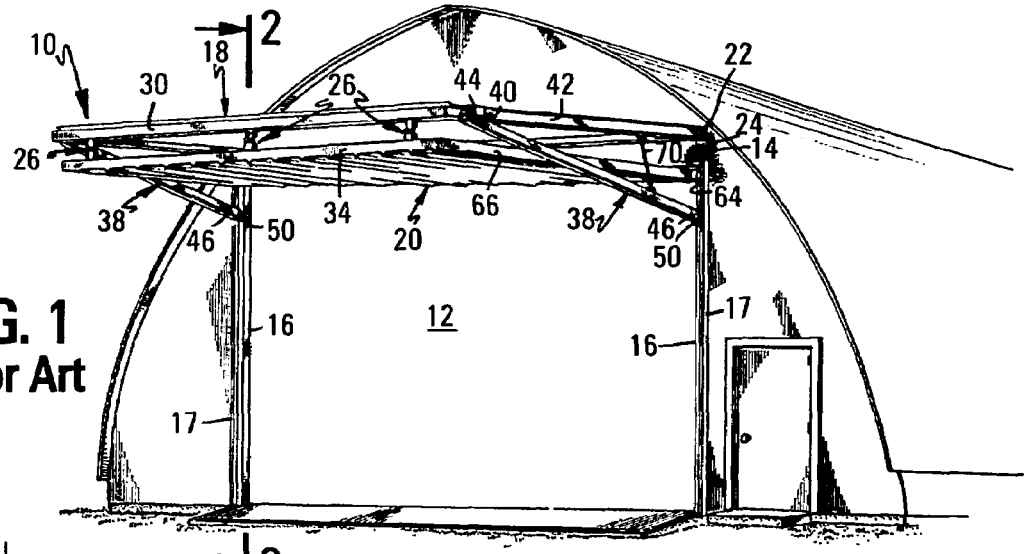
FIG. 1
Prior Art
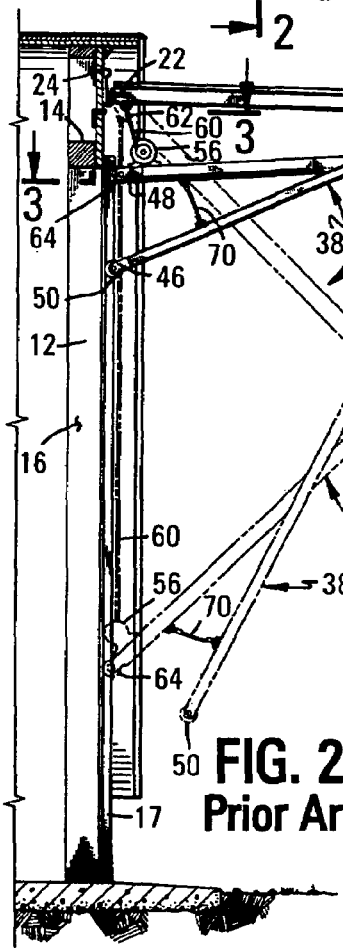
FIG. 2
Prior Art
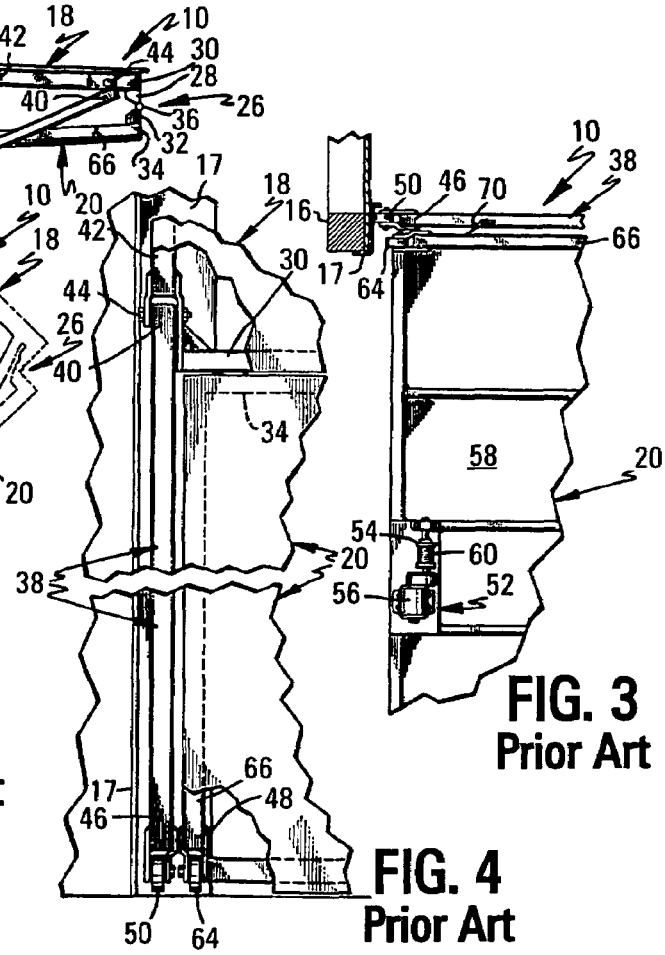
FIG. 3
Prior Art
FIG. 4
Prior Art

HYDRAULIC DOOR OPENING MECHANISM AND METHOD OF INSTALLING A BI-FOLD DOOR

RELATED APPLICATIONS

This application claims the benefit of U.S. Provisional Application No. 60/537,570 filed on Jan. 20, 2004 and U.S. Provisional Application No. 60/589,754 filed on Jul. 21, 2004, hereby incorporated by reference.

FIELD OF THE INVENTION

The present invention relates to a hydraulic door opening/closing mechanism for use with an overhead bi-fold door and a method of manufacturing and installing the same.

BACKGROUND OF THE INVENTION

Bi-fold doors have long been used wherever high clearance is needed in a doorway. Bi-fold doors are commonly used in agricultural, industrial, and aviation settings in lieu of the more common track mounted overhead door, as the bi-fold door does not require the same headroom as does the track mounted overhead door, the track mounting system being unnecessary for the bi-fold door.

Opening mechanisms for prior art bi-fold doors commonly use electric motors as the source of the forces needed to open the door. However, electric motors are somewhat limited in their output, the larger motors being somewhat heavy for the application. In addition, it is difficult to operate an electric motor in at varying speeds without losing a significant portion of the power output of the motor. Finally, electric motors are relatively slow in that the amount of torque that they put out allows the typical bi-fold door to be opened only in a steady state, slow manner.

It has been found, however, that a small, self-contained hydraulic door opening mechanism may be used in place of the standard electric motor to overcome the problems inherent in electric motors under such conditions.

It is an objective of the present invention to adapt a hydraulic motor and/or cylinder to open and close a bi-fold door. It is a further object of the present invention to provide a door opening mechanism that can quickly and quietly open a bi-fold door and also actuate automatic locking systems incorporated into the door. It is yet another object of the present invention to simplify the installation of a bi-fold door by pre-assembling the door with its door opening mechanism at the time of manufacture, leaving only the task of mounting the door on its hinges in the door opening and connecting electric power to the door opening mechanism. A final object of the present invention is to provide a hydraulically operated door opening mechanism that may be controlled through a hard-wired control circuit or wirelessly using a suitable transmitter and receiver.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DESCRIPTION OF THE DRAWINGS

FIG. 1 shows a perspective view of a prior art overhead door with the door in its fully open position.

FIG. 2 shows a cross sectional view of the prior art overhead door of FIG. 1 according to section line 2-2 of FIG. 1 and includes a phantom view of the door in a partially open condition.

FIG. 3 shows a cross sectional view of the prior art overhead door of FIG. 1 according to section line 3-3 of FIG. 2.

FIG. 4 is a fragmentary, front elevation view of the left side of the prior art overhead door in its closed condition.

Figure 5:
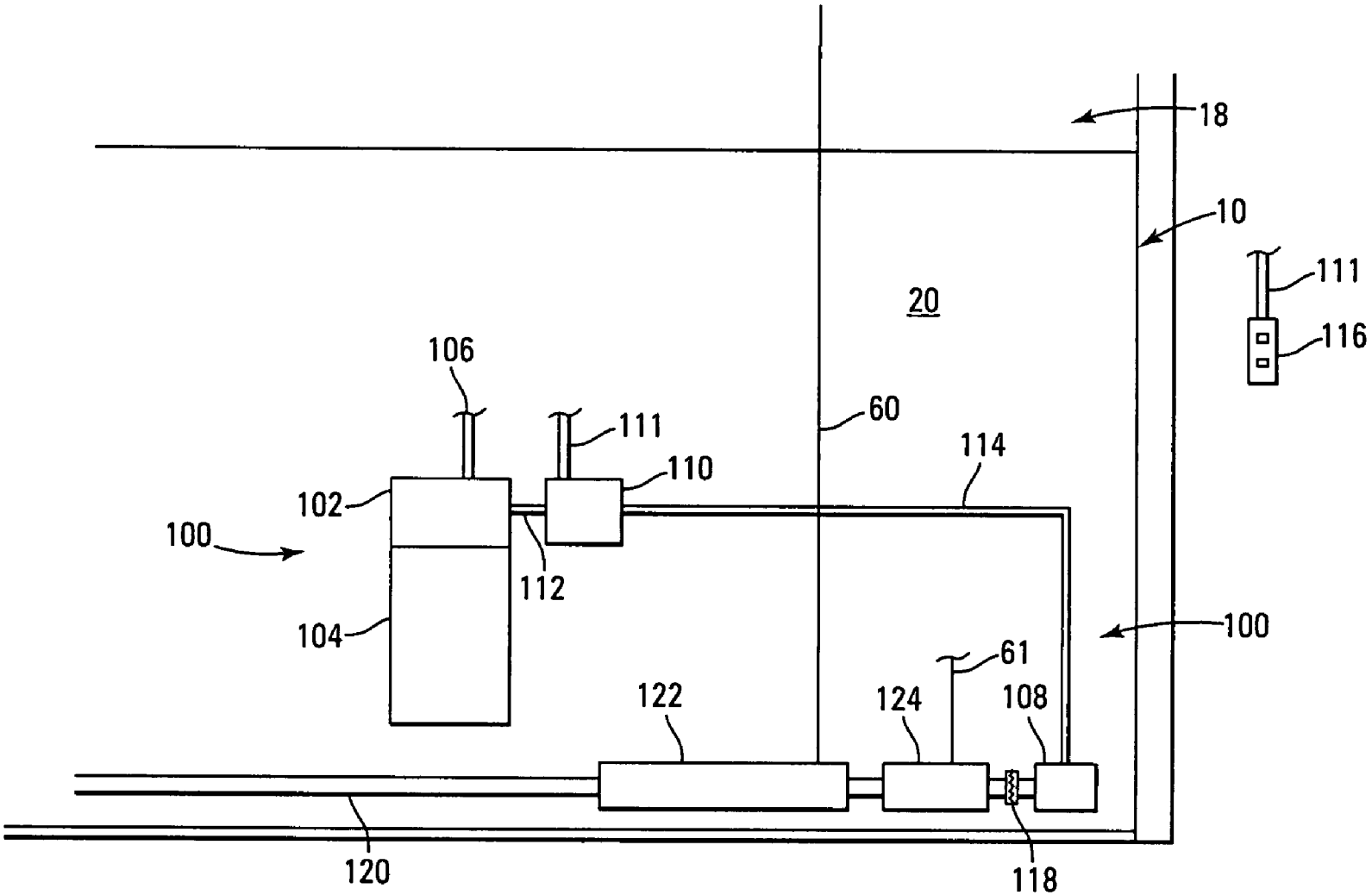
FIG. 5 is a schematic, front elevation view of a hydraulic door opening mechanism of the present invention including a hydraulic motor.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top," "bottom," "upper," "lower," "first," "second," "inside," "outside," and similar terms are used herein, it should be understood that these terms have reference only to the structure shown in the drawings as it would appear to a person viewing the drawings and are utilized only to facilitate describing the invention.

DETAILED DESCRIPTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

An overhead door constructed according to the teachings of the preferred embodiment of the present invention is shown in the drawings and generally designated by reference numeral 10. Door 10 is utilized for opening and closing a doorway 12 or other desired opening in a building or the like. Generally doorway 12 includes a horizontal header 14 and first and second vertical doorjambs 16 located on opposite ends of header 14.

Door 10 includes an upper door panel 18 and a lower door panel 20. Upper door panel 18 is hingedly mounted about a horizontal axis adjacent its upper edge 22 to header 14 by hinges 24. The horizontal axis of hinges 24 is located on header 14 at a spaced relation from doorway 12, and in one embodiment hinges 24 are located in the range of about nine inches from the top of doorway 12. Lower door panel 20 is hingedly mounted about a horizontal axis to the upper door panel 18 by pivot(s) 26 or by an equivalent hinge structure. A pivot 26 generally includes a pivot plate 28 that extends from the inside surface of upper door panel 18 adjacent to its bottom edge 30 and a pivot plate 32 that extend from the inside surface of the lower door panel 20 adjacent to its upper edge 34. A pivot pin 36 extends through and pivotally connects pivot plates 28 and 32 to one another to form a pivot 26.

Door 10 is generally moveable between a first, closed position where door panels 18 and 20 are vertically aligned to close doorway 12 and a second, open position where door panels 18 and 20 are generally horizontal and substantially parallel to each other. In some embodiments, the respective door panels may be of different widths. However, panels 18 and 20 both rest against doorjambs 16 around doorway 12 of the building when in its first, closed position.

Door 10 may include mechanisms for supporting the door 10 in its open position. Support mechanisms such as first and second brace members 38 have first ends 40 pivotally mounted to the side edges 42 of upper door panel 18 about a horizontal axis by pivot pins 44. In a preferred form, pins 44 are spaced apart from the bottom edge 30 of upper door panel 18. Also, brace members 38 may advantageously have a length greater than the height of lower door panel 20 and so extend to a height generally equal to the height of pins 44 above the bottom of doorway 12 when door 10 is in its closed position as shown in FIG. 4. Thus, in one particular embodiment, the second or lower ends 46 of brace members 38 may generally be even with the bottom end 48 of the lower door panel 20 when door 10 is in its closed position. Brace members 38 may further include rollers 50 at their second ends 46 for purposes to be explained further hereinafter.

Door 10 further includes rollers 64 located on opposite side channel beams 66 of lower door panel 20 adjacent its bottom end 48. Rollers 50 and 64 of brace members 38 and panel 20 roll along the outside surface of doorjambs 16, which may include suitable track members 17 to movable guide rollers 50 and 64.

Door 10, according to the teachings of the present invention, further includes flaccid members 70 shown in the most preferred form as cables extending between lower door panel 20 and brace members 38 adjacent the bottom edge of panel 20 and ends 46 of brace members 38.

The basic construction of door 10 according to the preferred teachings of the present invention having been set forth, the operation of door 10 will now be described. In operation, in its closed position, brace members 38 abut vertically with doorjambs 16 of door 12. When raising means 52 is activated thereby winding cable 60 on winch 54, bottom end 48 of panel 20 is vertically drawn upward by cable 60. Due to pivot 26 and hinges 24, door panels 18 and 20 begin to fold. As door 10 is thus raised upwardly, rollers 64 of panel 20 roll along doorjambs 16, and particularly along tracks 17 in the preferred embodiment. Door panels 18 and 20 are thus supported by hinges 24, pivot 26, and rollers 64. Brace members 38 do not initially provide support to door 10, and as is shown in phantom lines in FIG. 2, rollers 50 on braces 38 do not engage doorjambs 16 when door 10 is partially raised. As bottom end 48 of panel 20 is drawn upwardly, cables 70 become tight such that brace members 38 are raised with door panel 20. When door panel 20 is located adjacent to its open position, rollers 50 of brace members 38 engage with doorjambs 16 and tracks 17 thereon. As door 10 continues to move to its open position, brace members 38 support the bottom edge 30 of top door panel 18 to keep door panels 18 and 20 from tipping into doorway 12. When door 10 is in its open position, rollers 64 of door panel 20 do not have to engage the doorjambs 16.

When door 10 is moved from its open position to its closed position, cable 60 is unwound from winch 54 lowering bottom edge 48 of panel 20. Rollers 50 of brace members 38 then roll down the doorjambs 16 until rollers 64 engage with doorjambs 16 and support door 10. At that time, cables 70 hold brace members 38 adjacent to door panel 20 until door 10 is adjacent its closed position. In its fully closed position, brace members 38 abut against doorjambs 16 and lie against the building face. The narrower width of lower door panel 20 with respect to upper door panel 18 permits brace members 38 to be pivotally supported outside of side channel beams 66 of lower door panel 20 closely adjacent thereto and still lie against and be guided within tracks 17. Since brace members 38 have a length greater than the height of lower door panel 20, they are able to engage doorjambs 16 at an acute angle thereto as shown in FIG. 2 to properly support the outer or lower end 30 of upper door panel 18 with door 10 in its open position.

It can thus be appreciated that brace members 38 provide an angular support between the bottom edge 30 of upper door panel 18 and the doorjambs 16 to prevent the door panels 18 and 20 from pivoting downwardly as a unit about hinges 24 into doorway 12 when door 10 is raised to the fully open position of FIG. 2. Specifically, prior to the present invention, the bottom door panel was not typically moved into a parallel relation with the top door panel but angled downwardly and inwardly towards the building frame with a typical vertical header space of about two feet to serve as a support mechanism for the top panel. Thus, the overhead room with the door 10 in its open position was decreased and/or the total height of the door was increased to compensate for this triangular positioning of the door panels. Thus, utilizing brace members 38 according to the teachings of the present invention allows the door panels 18 and 20 to be positioned horizontally to each other while providing the support necessary to prevent the folded door from tipping into the doorway. In its preferred form, the vertical header space for door 10 according to the present invention is generally equal to the distance of hinges 24 from the top of doorway 12 and in the preferred embodiment is generally in the range of nine inches. Due to the horizontal positioning of door panels 18 and 20, the overhead space at doorway 12 is increased while minimizing door panel size according to the teachings of the present invention.

It should be further appreciated that lower door panel 20 is very securely held in the open position by cable 60 extending between the bottom end 48 of panel 20 and upper edge 22 of panel 18, and by its connection at pivot 26 to upper door panel 18.

Additionally, pivot plates 28 and 32, which position pivot pins 36 inwardly from edges 30 and 34 of door panels 18 and 20, allow door panels 18 and 20 to be horizontal in the open position of door 10. Specifically, if the pivotal connection between the door panels were located adjacent to their abutting edges, it would be necessary for the door panels to abut with each in order to be parallel to each other, a physical impossibility for many hinges. Furthermore, if the door panels are not in a horizontal position, the lower door panel then is angled downwardly and inwardly into the doorway, decreasing overhead room and resulting in other disadvantages as set forth hereinbefore.

It should be appreciated that the mounting of power means 52 adjacent to lower edge 48 of door panel 20 is advantageous over other mounting positions. Specifically, motor 56 and winch member 54 can be easily mounted to door panel 20 when door 10 is in its closed position without requiring the heavy lifting and positioning required when the motor and winch are mounted above the doorway 12. Furthermore, the weight of motor 56 and winch member 54 on door 10 acts as an anchor in providing dead weight thereto when door 10 is in its closed position to provide stability to door 10.

FIG. 5 schematically illustrates a door raising mechanism 100 according to one embodiment of the present invention. The mechanism 100 includes a hydraulic pump 102 that is operatively coupled to a hydraulic fluid reservoir 104. The pump 102 operates on known principals to maintain a predetermined operative hydraulic pressure at all times. Pump 102 is electrically coupled to a power source by connector 106.

Pump 102 is coupled to hydraulic motor 108 by means of valve manifold 110 that controls the flow of pressurized fluid through hydraulic lines 112, 114. Note that hydraulic lines 112, 114 are illustrated schematically and in the various embodiments of the present invention provide for a complete fluidic circuit that allows hydraulic fluid to flow from the reservoir 104, through pump 102 and manifold 110 to motor 108 and then back again to reservoir 104. Manifold 110 is operated remotely by control 116, shown in FIG. 5 mounted to the wall adjacent the door opening in which door 10 is mounted.

When so directed by control 116, manifold 110 permits pressurized fluid to pass from pump 102 through hydraulic lines 112, 114 to hydraulic motor 108. Rotary power generated by the motor 108 is transmitted through coupling 118 to shaft 120. Shaft 120 has mounted thereon one or more take-up spools 122 that act to raise or lower the door panels 18, 20 as previously described as cable 60 is wound up or off of the spool 122. An additional take-up spool 124 may be mounted on the shaft 120 to activate a door lock 126 such as that shown in FIGS. 7 and 8. Take-up spool 124 may have a cable 61 wound thereon.

The mechanism 100 for opening and closing the door 10 is mounted directly upon the door 10. While the mechanism 100 can be mounted on the door 10 during installation of the door 10 in a door opening, it is preferred to mount the mechanism of the door 10 at the time of manufacture and prior to the door's installation in opening 12.

The mechanism 100 is preferably mounted on the door 10 near the bottom edge of lower panel 20. The weight of the mechanism 100 acts to keep the door closed. In another embodiment, the mechanism 100 can be mounted on the upper door panel 18 to reduce the amount of weight that must be lifted and supported. A door can include one or more mechanisms 100, and can have any useful ratio of motors 108 to pumps 102, reservoirs 104 or manifolds 108. By way of example only, a single, properly sized reservoir 104 may be coupled to multiple hydraulic motors 102 through a single manifold 110 or through multiple manifolds 110, all of which is coupled to control 116.

The manifold 110 includes the necessary fluid flow valving to effect the flow of pressurized fluids needed to activate the motor 108. The manifold 110 allows for selective control of the opening and closing of the door 10 and can raise or lower the door at various speeds and over varying distances. Where the door 10 is provided with two motors 108 to raise and lower the door 10, the motors 108 can be controlled jointly or independently of one another. Independent control of motor 108 allows for precise closure and opening of the door 10 and can obviate the need for manually adjusting the door opening and closing mechanism 100. The travel of the door 10 between its open position and closed position can be managed automatically by positioning sensors that detect the position of the door and control the manifold and motors accordingly. Alternatively, the position of the door 10 can be controlled mechanically by its placement of mechanical stops that actuate the manifold 110 mechanically or through control 116 so as to stop the motor 108.

The control 116 may be hardwired directly to manifold 110 as by connector 111 or may be coupled remotely thereto as by radio signal or similar communicating means. As can be appreciated, the control 116 may be hardwired directly to the manifold 110 by connector 111 while additional controllers (not shown) are wirelessly connected to manifold 110.

The motor 108 may be connected directly inline with shaft 120 as shown in FIG. 5 or may be connected through a transmission 119 (see FIG. 7) that allows for misalignment of the motor 108 and shaft 120. Similarly, resilient couplers may be used as shown at 118 to accommodate slight misalignment and to cushion the application of torque from the motor 108 to shaft 120. Preferably, the motor 108 will be operated so as to quickly open and close the door 10 without applying high impulse forces to the shaft 120 is such a way as to damage the various components of the door 10 or mechanism 100. Note that because of the power and control available from the application of hydraulic power to the door opener, the door 10 may be opened and closed at variable rates, some of which are much faster than that of an electric door opener. Accordingly, it is possible to open and close a bi-fold door 10 at numerous rates that may be faster, slower, or discontinuous with respect to the rates at which an electric door opener can operate. In some applications, particularly in smaller applications of the type used in standard garages and in small airplane hangars, it is possible that a bi-fold door 10 may be opened and closed in a time of about 8-10 seconds, a time that is generally faster than that of a door having an electric door opener/closer. It is also to be understood that multiple opening mechanisms 100 may be mounted on a door 10. This is particularly useful where the door 10 has a large height and/or width.

The motor 108, manifold 110, or pump 102 will preferably be provided with an external or internal brake (not shown) of a mechanical or hydraulic nature that will prevent the rapid closure of the door 10 should power to the mechanism 100 be suddenly lost.

Figure 6:
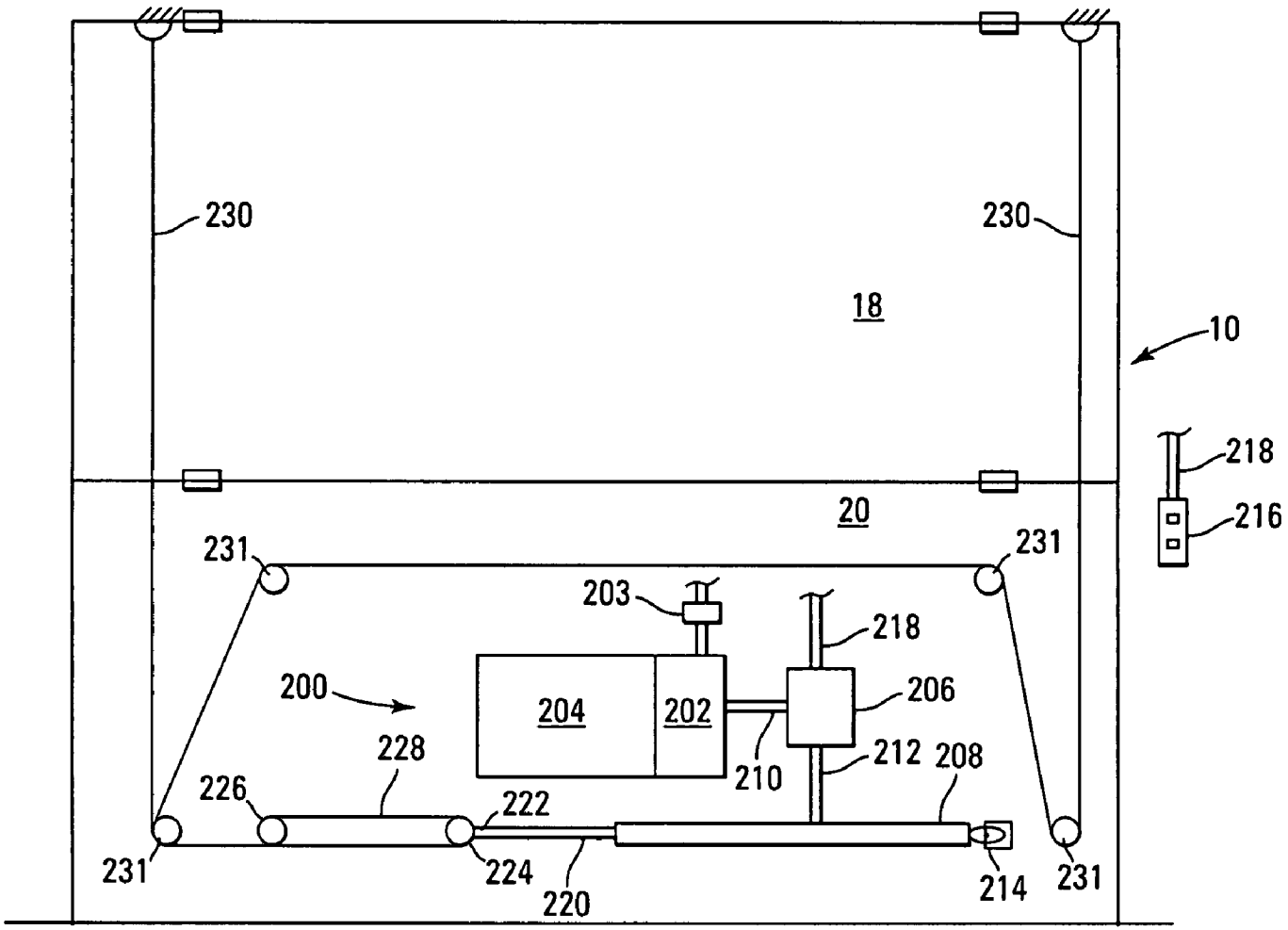
FIG. 6 is a schematic, front elevation view of a hydraulic door opening mechanism of the present invention including a hydraulic cylinder.

An alternate embodiment of a hydraulic door opening mechanism is illustrated in FIG. 6. This door opening/closing mechanism is schematically identified as 200 in FIG. 6. Door opening mechanism 200 includes a reservoir 204 that is coupled to a pump 202. The pump 202 is in turn coupled to a manifold 206 by hydraulic line 210. Manifold 206 is coupled by hydraulic line 212 to a hydraulic cylinder 208. Note that hydraulic lines 210 and 212 are illustrated schematically in FIG. 6 and in practice provides a complete hydraulic circuit that permits hydraulic fluid to flow from the reservoir 204, through pump 202 and manifold 206 to cylinder 208 and back again. Cylinder 208 is secured at a base end 214 to door 10.

Manifold 206 is controlled by controller 216 and may be hard wired directly to the controller as by connector 218 or controlled wirelessly by a suitable transmitted/receiver mechanism(s). Pump 202 is also provided with power through power conduit 203.

Hydraulic cylinder 208 has a rod 220 that is moveable between an extended position (seen in FIG. 6) and a retracted position. A distal end 222 of rod 220 has affixed thereto a pulley(s) 224 that is opposed by pulley(s) 226. Pulley(s) 226 is secured to door 10 such that pulley 224 moves relative to pulley 226 as rod 220 moves between its extended and retroacted positions.

One or more cables 228 are wound about pulleys 224, 226 such that the linear motion of rod 220 is multiplied. Cables 228 are in turn coupled to cables 230 that act to raise and lower the door 10. Cables 230 are passed around traveler pulleys 231 to that direct the cables 230 into an appropriate position to open and close the door 10. The relationship between the linear motion of the rod 220 and that of cables 230 may be controlled by specifying the appropriate pulley diameters. As can be appreciated, the travel of its rod 220 must be sufficient to fully open and close the door 10. Note that multiple mechanisms 200 may be provided to open and close the door 10.

A door 10, complete with opening/closing mechanism 100 or 200 may be manufactured and installed as follows. The dimensions of a door opening are obtained and the door 10 and its panels 18 and 20 are sized accordingly. The respective door panels 18, 20 are then hinged to one another. Once the panels 18, 20 of the door 10 are secured to one another, the pump 102, reservoir 104, manifold 110, motor 108 or cylinder 208, and associated hydraulic lines 112, 114 are secured to the frame of the door 10 in their operative positions. Shaft 120 and spools 122, 124 are next mounted in their operative positions on the door 10. Where the door 10 is provided with a cylinder 208, pulleys 224, 226, and 231 are mounted in their desired positions and cables 228 and 230 are installed. At this stage, the door 10 is functionally complete and needs only to be secure within the door opening. Once the door 10 is hung in its opening, connector 106 is coupled to a power source (not shown) and control 116 is mounted.

Figure 7:
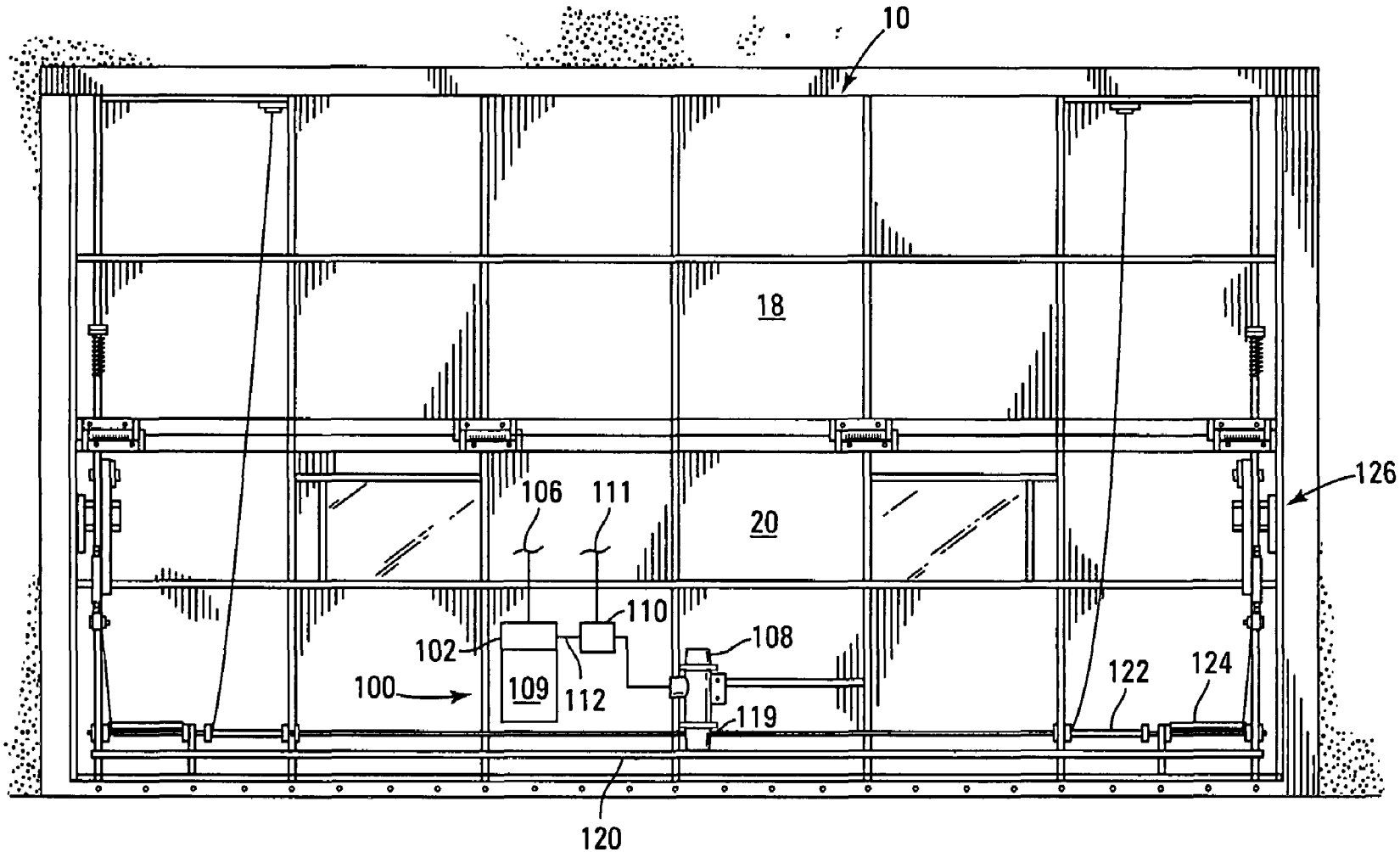
FIG. 7 is a front elevation of an embodiment of the hydraulic door opening mechanism of FIG. 5.
Figure 8:
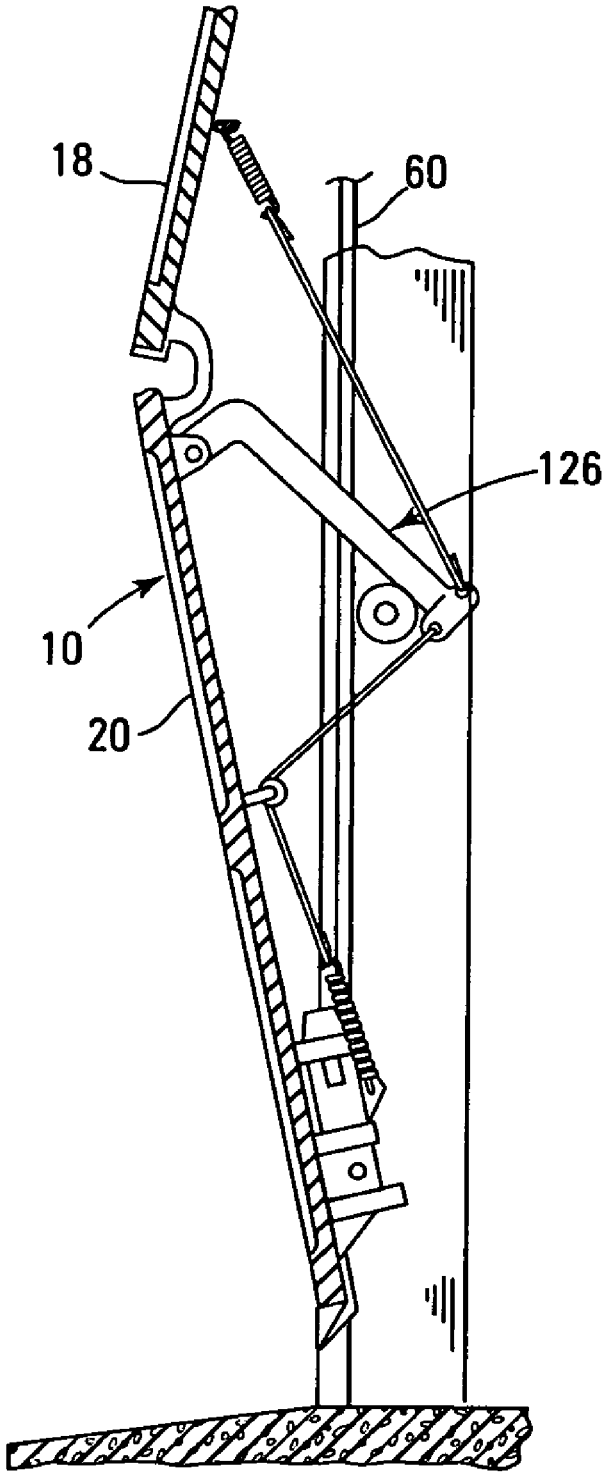
FIG. 8 is a side elevation of the embodiment of the hydraulic door opening mechanism of FIG. 7.
Figure 9:
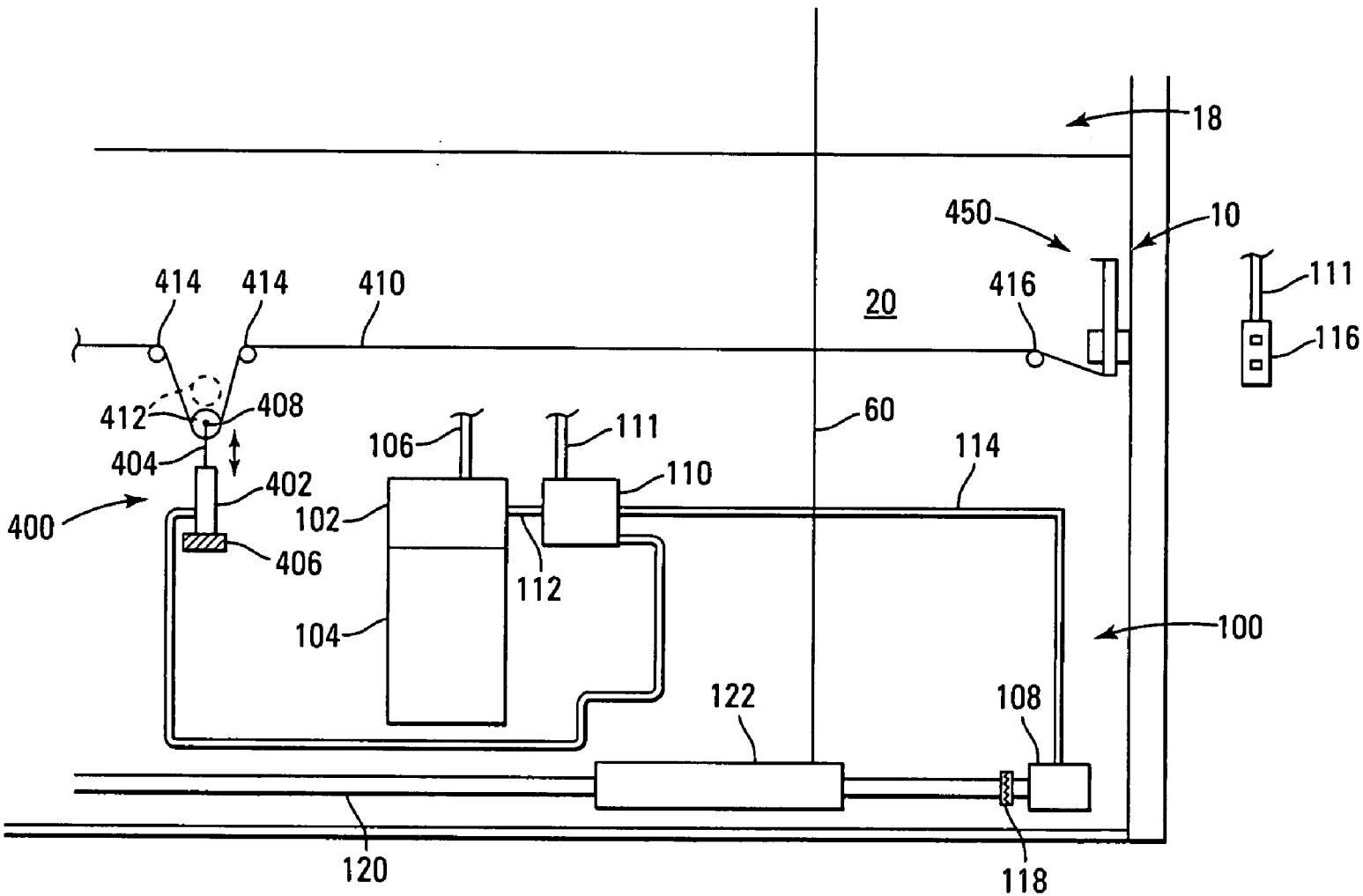
FIG. 9 is a schematic, front elevation view of an embodiment of a hydraulic door opening mechanism that includes a hydraulic door locking mechanism.

A door latch mechanism 350 is shown in FIG. 9 in a first, closed position in which the door latch mechanism 350 has secured a lower panel 20 of the bi-fold door 10 to its jamb 16. Door latch mechanism 350 is adapted to work in conjunction with a door opening/closing mechanism 100 or 200 such as those illustrated in FIGS. 5 and 6. The hydraulic power units of the door opening/closing mechanisms 100 and 200, consisting of a reservoir 102, 104, a pump 104, 204, and a manifold 110, 206, may be readily adapted to actuate disparate types of door latch mechanisms 350. By way of example only, the hydraulic mechanisms of door opening/closing mechanisms 100 or 200 of the present invention may be used to actuate door latch mechanisms such as those described in U.S. Pat. Nos. 4,609,027, 5,343,923, 5,168,914, and 6,547,292, all of which are commonly assigned herewith and incorporated by reference herein. An exemplary embodiment of door latch 126 of a type that may be actuated by a door opening/closing mechanism 100 or 200 is seen in FIGS. 7 and 8.

In one embodiment, an actuating mechanism 400 for actuating a door latch mechanism 350 includes a hydraulic cylinder 402 having a reciprocable piston 404 slidably received therein. A base 406 of cylinder 402 is coupled to the lower panel 20 of the door 10. A distal end 408 of the piston 404 has a pulley 412 coupled therein. A cable 410 is passed around pulley 412 and extends laterally from the hydraulic mechanism 400 around a number of additional pulleys 414 and 416 to the door latch mechanism(s) 350. Where so desired, a resilient member (not shown) may be coupled between the piston 404 and the pulley 412 or between the cylinder 402 and the base 406 to ensure that a desirable minimum amount of tension is applied to the cable 410.

The door latch mechanism 350 may be actuated between an open position in which the door 10 may open and close and a closed or locked position in which the door latch mechanism 350 secures the door 10 to its jamb 16 by means of cylinder 402. Where the door 10 is in its fully closed position as shown and it is desired to secure the door 10 to its jamb 16, the manifold 110 supplies pressurized fluid from the pump 102 to the cylinder 402 such that the piston 404 is retracted. The retraction of piston 404 tensions cable 410 and moves the door latch mechanism 350 into its closed or locked position. Conversely, the manifold 110 may supply to, or release, pressurized fluid from the cylinder 402 so as to extend the piston 404, thereby releasing the door latch mechanism 350 to move back to its open position, shown in phantom lines. When the door latch mechanism 350 is in its open position, the door 10 is free to open and close.

Note that where a single door latch mechanism 350 is used, the end of the cable 410 not attached to the door latch mechanism 350 will be secured to the door panel 20 or directly to the piston 404. Where two door latch mechanisms 350 are used, the door latch mechanisms 350 will be coupled to the piston 404 by pulleys 412, 414, 416 as shown and described. In one embodiment, the hydraulic mechanism 400 may utilize a rotary actuator that winds cable 410 up on a drum (not shown) to actuate the door latch mechanism 350.

In another embodiment, a cylinder 402 may be secured directly between the door latch mechanism 350 and the door panel 18 or 20 to which the door latch mechanism 350 is secured. In this manner, the cylinder 402 may directly reciprocate or operate the door latch mechanism 350 between the latch mechanism's open and closed positions.

It is also to be understood that multiple hydraulic mechanisms 400 may be provided to actuate the door latch mechanism 350. By way of example only, where the door latch mechanism 350 is spring biased to return to its open position when an actuating force placed upon the mechanism 350 is released, a one way or single acting actuator or cylinder may be used, the single acting actuator applying and releasing an actuating force on the door latch mechanism 350 rather than actively actuating the door latch mechanism 350 between its open and closed positions. A double acting hydraulic actuator may be used to actively actuate the door latch mechanism between its open and closed positions where the door latch mechanism 350 is not resiliently biased towards its open position. Alternatively, multiple single acting actuators may be employed, each actuator performing a single, predetermined function. For example, a first single acting actuator may be used to open the door latch mechanism 350 and a second single acting actuator may be used to open the door latch mechanism 350.

Note that in operation, the hydraulic actuation mechanism 400 will work in conjunction with a door opening mechanism 100 to automatically open/close and unlock/lock the door 10. As can be readily appreciated, the door latch mechanism 350 must be opened/unlocked before the door 10 can be opened. Accordingly, the door latch mechanism will be actuated to its open position before the door 10 is opened. At the very least, the controls for the door 10 and door latch mechanism 350 (preferably combined as at 116) will ensure that the door 10 may not be opened without first determining that the door latch mechanism 350 is in its open position. Similarly, the controls 116 will be constructed and arranged such that the door latch mechanism 350 will not be actuated unless the door 10 is in its closed position. The arrangement of the controls 116 that enables the correct and safe operation of the hydraulic actuator 400 and door latch mechanism 350 may be microprocessor controlled and/or determined by the status/position of a plurality of position/limit switches (not shown).

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes that come within the meaning and range of equivalency of the claims are intended to be embraced therein.

What is claimed is:

1. A bi-fold overhead door comprising:

a first door panel rotatively coupled to a header of a door opening by a hinge structure;

a second door panel rotatively coupled to a lower edge of the first door panel;

a rotatable shaft secured to the second door panel adjacent a lower edge thereof, the rotatable shaft having a take up spool mounted thereon, the take up spool having a first end of a cable secured thereto, a second end of the cable being secured to the header of the door opening such that as the rotatable shaft rotates, the take up spool winds the cable up on the take up spool, thereby raising the lower edge of the lower panel and raising the overhead door; and, a hydraulic power unit coupled to a hydraulic motor, the hydraulic motor being coupled to the rotatable shaft for rotating the shaft so as to wind the cable on the take up spool.

2. The bi-fold overhead door of claim 1 wherein the hydraulic motor is coupled to the rotatable shaft by a transmission.

3. The bi-fold overhead door of claim 1 wherein the hydraulic motor is coupled to the rotatable shaft by a resilient coupling.

4. The bi-fold overhead door of claim 1 wherein the hydraulic motor is coupled to the rotatable shaft by rigidly bolting the hydraulic motor to the rotatable shaft.

5. The bi-fold overhead door of claim 1 wherein the hydraulic power unit comprises:

a fluid reservoir for containing hydraulic fluid;

a hydraulic pump coupled to the fluid reservoir such that hydraulic fluid may flow from the fluid reservoir to the hydraulic pump;

a valve manifold coupled to the hydraulic pump to control the flow of hydraulic fluid from the hydraulic pump; and, the hydraulic power unit being coupled to a panel of the overhead door.

6. The bi-fold overhead door of claim 1 further comprising:

a door latch mechanism having a rotating arm coupled at a base end to a panel of the overhead door, the door latch mechanism being adapted to engage a post secured to a door jamb of the door opening in which the overhead door is installed;

a hydraulic cylinder coupled to a panel of the overhead door at a base end thereof, an extendable shaft of the hydraulic cylinder being coupled to the rotating arm of the door latch mechanism to rotate the rotating arm between an unlocked position in which the arm is positioned away from the post on the door jamb and a locked position in which the arm is engaged with the post on the door jamb.

7. The bi-fold overhead door of claim 6 wherein the hydraulic cylinder is coupled to the rotating arm of the door latch mechanism by a cable passed around a pulley.

8. The bi-fold overhead door of claim 6 wherein the shaft of the hydraulic cylinder is directly coupled to the rotating arm of the door latch mechanism.

9. A bi-fold overhead door comprising:

a first door panel rotatively coupled to a header of a door opening by a hinge structure;

a second door panel rotatively coupled to a lower edge of the first door panel;

a hydraulic cylinder coupled at its base to the second panel of the door, the hydraulic cylinder having an extensible shaft having a first pulley coupled to its end such that the pulley travels with the end of the shaft;

a second pulley fixed to the panel of the overhead door to which the hydraulic cylinder is secured such that the second pulley remains in its fixed position on the door panel;

a door opening cable having a first end secured to the header of the door opening and a second end secured to the second door panel, the door opening cable being passed around the first and second pulleys such that retracting the shaft of the hydraulic cylinder will alter the length of the door opening cable extending between the second pulley and the door header, thereby causing the overhead door to open; and, a hydraulic power unit coupled to the hydraulic cylinder to provide motive power for retracting the shaft of the hydraulic cylinder.

10. The bi-fold overhead door of claim 9 wherein the first pulley comprises a plurality of pulley sheaves and the second pulley comprises a plurality of pulley sheaves, the door opening cable being passed around the first and second pulleys multiple times.

11. The bi-fold overhead door of claim 9 wherein the overhead door is opened upon extension of the shaft of the hydraulic cylinder.

12. The bi-fold overhead door of claim 9 further comprising:

a door latch mechanism having a rotating arm coupled at a base end to a panel of the overhead door, the door latch mechanism being adapted to engage a post secured to a door jamb of the door opening in which the overhead door is installed;

a second hydraulic cylinder coupled to a panel of the overhead door at a base end thereof, an extendable shaft of the second hydraulic cylinder being coupled to the rotating arm of the door latch mechanism to rotate the rotating arm between an unlocked position in which the arm is positioned away from the post on the door jamb and a locked position in which the arm is engaged with the post on the door jamb.

13. The bi-fold overhead door of claim 12 wherein the hydraulic cylinder is coupled to the rotating arm of the door latch mechanism by a cable passed around a pulley.

14. The bi-fold overhead door of claim 12 wherein the shaft of the second hydraulic cylinder is directly coupled to the rotating arm of the door latch mechanism.

15. A method of installing a bi-fold overhead door in a door opening comprising:

fabricating an upper panel frame;

fabricating a lower panel frame;

coupling the upper and lower panel frames to one another with a hinge mechanism;

coupling a door raising mechanism to the lower panel frame adjacent a lower edge of the lower panel frame;

coupling a hydraulic power unit to one of the upper and lower panel frames and to the door raising mechanism, the hydraulic power unit providing motive power to the door raising mechanism;

securing an upper edge of the upper panel frame to a header of a door opening; and, covering the upper and lower panel frames.

16. The method of installing a bi-fold overhead door of claim 15 wherein the hydraulic power unit comprises one of a hydraulic motor and a hydraulic cylinder.

17. The method of installing a bi-fold overhead door of claim 15 further comprising:

securing to one of the upper and lower door panel a door latch mechanism having a rotatable arm; and, securing to a doorjamb of the door opening a post in a position in which the rotatable arm of the door latching mechanism may selectively engage the post.

18. The method of installing a bi-fold overhead door of claim 17 further comprising:

securing a base of a hydraulic cylinder to one of the upper and lower door panels; and, coupling a distal end of an extendable shaft of the hydraulic cylinder to the rotatable arm of the door latch mechanism.

* * * * *